US005259520A

United States Patent [19]

Roggio et al.

[11] Patent Number: 5,259,520

[45] Date of Patent: Nov. 9, 1993

[54] CURTAIN ROD ASSEMBLY AND COVER

[75] Inventors: Robert S. Roggio, Chadds Ford, Pa.; Paul H. Winter, Wilmington, Del.

[73] Assignee: Zenith Products Corp., Aston, Pa.

[21] Appl. No.: 841,683

[22] Filed: Feb. 26, 1992

[51] Int. Cl.[5] ..... A47F 5/00

[52] U.S. Cl. ..... 211/105.1; 16/94 D; 16/95 D

[58] Field of Search ..... 211/105.1, 123; 16/87.4 R, 95 R, 95 D, 94 R, 94 D, 93 D

[56] References Cited

U.S. PATENT DOCUMENTS

| | | | |
|---|---|---|---|
| 3,643,288 | 2/1972 | Olivari | 16/96 |
| 3,703,740 | 11/1972 | Mann et al. | 16/87.2 |
| 3,943,598 | 3/1976 | Fielder, Jr. | 16/93 D |
| 4,014,072 | 3/1977 | Schumacher | 16/95 R |
| 4,068,345 | 1/1978 | Hehl et al. | 16/94 D |
| 4,178,656 | 12/1979 | MacFarlane | 16/93 D |
| 4,216,564 | 8/1980 | Froutzis | 16/93 D |
| 4,485,523 | 12/1984 | Higgins | 16/94 D |
| 4,782,554 | 11/1988 | Lawson | 16/87.4 R |
| 4,865,105 | 9/1989 | Peters | 160/38 |
| 4,935,988 | 6/1990 | Ford et al. | 16/87.4 R |
| 4,999,874 | 3/1991 | White | 16/95 D |

*Primary Examiner*—Robert W. Gibson, Jr.

*Attorney, Agent, or Firm*—Panitch Schwarze Jacobs & Nadel

[57] ABSTRACT

The present invention is a curtain rod assembly for supporting a generally tubular rod cover and a slidable curtain. The assembly includes a generally tubular member having a longitudinal slot therein and a generally tubular pliable cover surrounding substantially the entire length of the tubular member. The assembly also includes a track having a first, generally T-shaped member which may be inserted into the slot to retain a portion of the cover in the slot. The T-shaped member includes a first and second member, the width of the second member being greater than the width of the slot in the tubular member for retaining the cover and track within the slot. The track also includes a second member for receiving and permitting sliding movement of a plurality of retainers for a depending curtain.

20 Claims, 1 Drawing Sheet

CURTAIN ROD ASSEMBLY AND COVER

FIELD OF THE INVENTION

The invention relates to a curtain rod assembly and cover and, more particularly, to an assembly for supporting a generally tubular rod cover and a slidable curtain.

BACKGROUND OF THE INVENTION

Typical prior art curtain rod assemblies lack aesthetic appeal. While such curtain rod assemblies are functionally adequate to permit curtains or blinds suspended from the assembly to be adjusted to a variety of positions, unsightly metallic or plastic rod or track components often detract from the appearance of the assembly.

The prior art has attempted to solve this problem in a number of ways. For example, there is disclosed in the prior art curtain rod assemblies having plastic or coated steel fascia for encasing a portion of a track assembly and concealing the assembly from view. However, such fascia is often unsightly itself, difficult to assemble, and is not readily interchangeable to achieve a custom match with a variety of curtains.

The prior art also discloses a drapery mount for a recreational vehicle which includes a fabric cover attached to the front portion of the mount. The cover is anchored in a receptor, wrapped around the front of the mount, and anchored by an anchoring member under the top of the mount. While the cover material may be varied, assembly of such covered mounts is often difficult and time consuming.

There is also disclosed in the prior art a drapery rod assembly having a longitudinally split tubular cover covered with a section of decorated fabric extending over the outer surface of the split tubular cover. The fabric is clamped in position on the cover between flanges of the cover and oppositely disposed flanges on the body member of the drapery rod. Slots are formed in the body member for suspending drapery hooks or the like.

A window cornice assembly is disclosed in the prior art which includes a hollow cylinder of fabric disposed over an arcuate or semi-circular front plate. A slidable curtain may be mounted on a third curtain rod means mounted separately from the window cornice assembly.

The prior art also discloses a fabric covered drapery rod having a longitudinal slot and grooves formed along the edges of the slot for anchoring the fabric using frictional tucking strips.

The aforementioned prior art curtain rod assemblies are often difficult to assemble and do not permit covers to be readily interchanged as desired or adjusted after assembly. An economical and functional curtain rod assembly which is easily installed, aesthetically appealing and permits the cover and curtain to be readily interchanged as well as adjusted after mounting is a long-felt but unfulfilled need in the art.

SUMMARY OF THE INVENTION

According to the present invention, the above and other deficiencies of the prior art are alleviated or eliminated by a curtain rod assembly for supporting a generally tubular rod cover and a slidable depending curtain. The assembly comprises a generally tubular member having a longitudinal slot and a generally tubular pliable cover surrounding substantially the entire length of the tubular member. The assembly also comprises a track having a first means for releasably retaining a portion of the cover within the slot of the tubular member and a second means for receiving and permitting sliding movement of a plurality of retainers for the depending curtain.

In another aspect, the invention is a curtain rod assembly for supporting a pliable, generally tubular rod cover and a slidable depending curtain, comprising a generally tubular member having an elongated longitudinal slot and a track. The track has a first means configured to be inserted generally radially through said slot with a portion of said cover and retained by the tubular member and for being selectively removed from said tubular member by withdrawal radially through said slot so as to releasably retain said portion of said cover within said slot. The track further has a second means for receiving and permitting sliding movement of a plurality of retainers for said depending curtain.

Another aspect of the present invention is a curtain rod assembly for supporting a generally tubular cover and a slidable depending curtain, comprising a generally tubular member having a longitudinal slot therein defining a opening in the tubular member of a given width. The assembly also comprises a track having a first means for retaining a portion of the cover within the slot of the tubular member. The first means comprises a shaped portion projecting from the track. The shaped portion comprises a first member and second member oriented generally laterally to the first member. The second member comprises a first arm and a second arm extending away in opposing directions from the first member. Each arm has a width in a direction laterally away from the first member, a sum of the widths of the first arm and the second arm being greater than the width of the slot for retaining the second member within the slot. The width of the first arm is greater than the width of the second arm. The track also has a second means for receiving and permitting sliding movement of a plurality of retainers for a depending curtain.

BRIEF DESCRIPTION OF THE DRAWING

The foregoing summary, as well as the following detailed description of the preferred embodiment of the invention, will be better understood when read in conjunction with the appended drawing. For the purpose of illustrating the invention, there is shown in the drawing an embodiment which is presently preferred, it being understood, however, that the invention is not limited to the specific methods and instrumentalities disclosed. In the drawing.

DESCRIPTION OF THE PREFERRED EMBODIMENT

Figure 1:
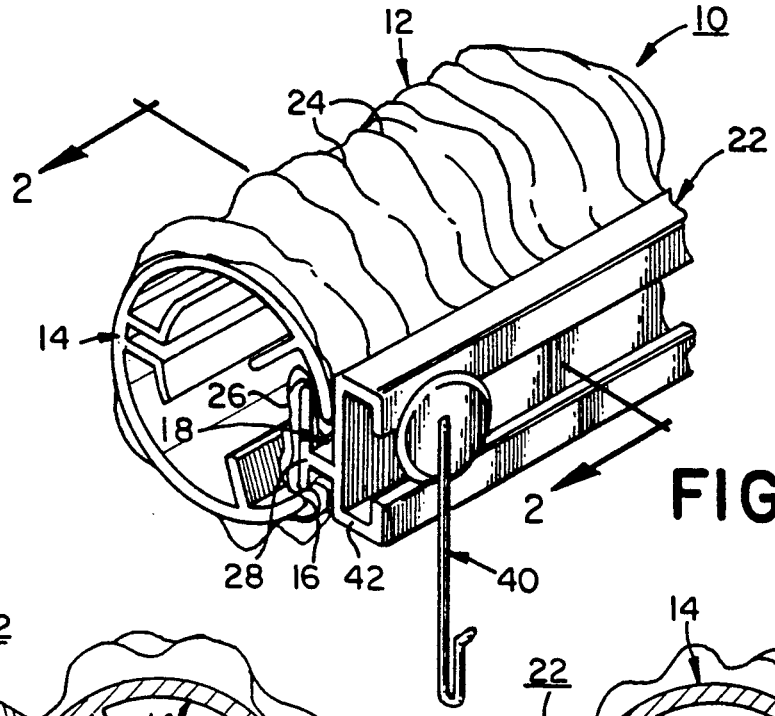
FIG. 1 is a perspective view of the curtain rod assembly in accordance with the present invention.

Certain terminology is used in the following description for convenience only and is not limiting. The words "upwardly", "downwardly", "inwardly", "outwardly", "top" and "bottom" designate directions in the drawing to which reference is made. The terminology, includes the words above as specifically mentioned, derivatives thereof, and words of similar import.

Referring to the drawing, wherein like numerals indicate like elements throughout, there is shown in FIG. 1 a preferred embodiment of a curtain rod assembly, generally designated 10, for supporting a generally tubular rod cover 12 and a slidable depending curtain (not shown). The assembly 10 may be installed between first and second support structures (neither shown), such as walls. The assembly may be mounted between walls, for example, by the use of mounting brackets, adhesives, and other mounting means well known to those of ordinary skill in the art. The assembly may be installed in a room of a private dwelling, such as a bathroom or a living room or in a commercial place of business, for example. Further discussion of the installation of the curtain rod assembly between the first and second structures is not necessary to an understanding of the present invention and, therefore, further discussion thereof will be omitted.

As best shown in FIG. 1, the curtain rod assembly 12 comprises a generally tubular member 14 having a longitudinal slot, indicated generally at 16. The tubular member 14 is preferably generally elongated and circular in cross section, although one of ordinary skill in the art would understand that the tubular member 14 may have a cross-sectional shape of a square, rectangle, oval, or any other shape in keeping with the spirit and scope of the present invention.

The generally tubular member 14 is preferably formed from a substantially rigid material of sufficient strength to support the cover 12 and depending curtain, preferably a metal such as aluminum or a thermoplastic, such as polyvinyl chloride, for example, or even wood. The tubular member 14 may be formed by a variety of methods well known to one of ordinary skill in the art, such as extrusion, molding, rolling or drawing, to name a few. The method of forming the tubular member 14 depends on, among other considerations, the material from which the tubular member is to be formed.

The tubular member 14 includes a longitudinal slot 16, which is elongated and preferably extends along the entire length of the tubular member 14. One of ordinary skill in the art would understand that the slot 16 need not be formed along the entire length of the tubular member, but may be formed along a single portion or a plurality of portions of the tubular member 14, as desired. The slot 16 may be formed during or subsequent to formation of the tubular member 14. For example, the slot 16 may be formed by cutting a portion of the tubular member 14.

As best shown in FIG. 1, the slot 16 defines an opening 18 in the tubular member 14 having a given width, which extends in a direction between longitudinal edges of the tubular member 12 defining slot 16. The width of the opening 18 is preferably substantially uniform along the entire length of the tubular member 14, although the opening 18 may vary at any point along the length of the member 14, as desired. Preferably, the width should be sufficient to permit a portion of the cover 12 and track 22 to be inserted into the member 14 through the slot 16.

The curtain rod assembly 10 also comprises a generally tubular, preferably pliable cover 12 surrounding substantially the entire length of the tubular member 14. Preferably, the cover 12 is generally circular in cross section, however, one of ordinary skill in the art would understand that the cover 12 may have any desired cross-sectional shape of sufficient circumference to surround the circumference of the tubular member 14.

The cover 12 is formed from a pliable material, such as plastic sheet of film, or a fabric, woven or unwoven, with or preferably without lamination(s) or coating(s). The cover 12 may be formed by a variety of methods well known to those of ordinary skill in the art. Preferably, the cover 12 is formed from the same material as the depending curtain.

It is preferred that the cover 12 be at least as long as the tubular member. It is further preferred that cover 12 has a plurality of gathers 24 formed to enhance the aesthetic appearance of the cover 12. The gathers 24 may be formed in a cover 12 having a length greater than the length of the tubular member 14, preferably about two-and-one-half to three times the length of the tubular member 14, for example. One of ordinary skill in the art would understand that the size and number of gathers 24 depends upon such factors as the length and thickness of the cover 12 and the nature of the material from which the cover 12 is formed. For example, a stiffer fabric would tend to form more sharply peaked gathers 24 than a more pliable fabric. One of the advantages of the present invention is that the gathers can be adjusted after the rod assembly and cover have been installed.

Figure 2A:
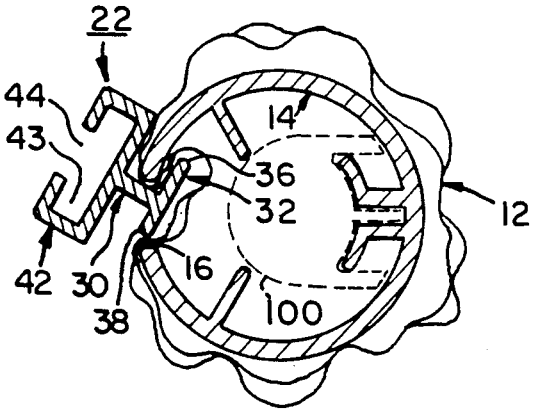
FIG. 2A is a cross-sectional view of the curtain rod assembly of FIG. 1 taken along 2—2 of FIG. 1, showing the first arm of the track being inserted into the slot.
Figure 2B:
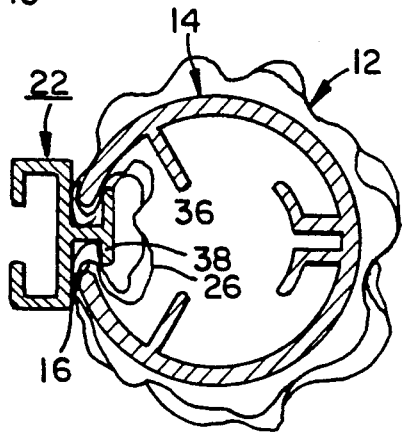
FIG. 2B is a cross-sectional view of the curtain rod assembly of FIG. 1 taken along 2—2 of FIG. 1, showing the second arm being inserted in the slot.

As best shown in FIG. 1, the assembly 10 also comprises a track 22, which may be formed from an appropriate material such as aluminum or other metal or plastic or even wood. The material from which the track 22 is formed should possess sufficient strength and rigidity to support the weight of a depending curtain and be retained in slot 16. The track 22 may be formed from the same material as that of the tubular member 14, although one of ordinary skill in the art would understand that the track 22 may also be formed of a more pliable material than that of the tubular member 14 to facilitate assembly. The track 22 may be formed by any conventional processing method appropriate to the material selected and desired structure of the track 22, such as extrusion, drawing, etc. Preferably, both the tubular member 14 and track 22 are extruded or drawn. This provides cross-sectional profiles to those elements, which are seen in FIGS. 2A–2C and which are unchanging along the lengths of those elements 14, 22.

Figure 2C:
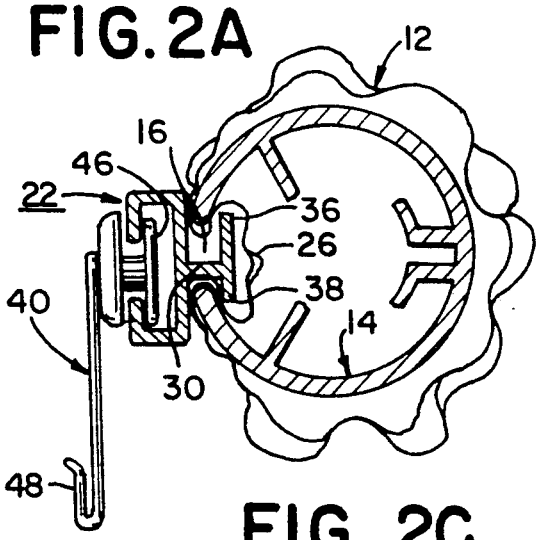
FIG. 2C is a cross-sectional view of the curtain rod assembly of FIG. 1 taken along 2—2 of FIG. 1, showing the first means positioned within the slot and a retainer positioned within the second means of the track.

The track 22 has a first means, indicated generally at 28, which is configured for being inserted generally radially through slot 16 with a portion 26 of cover 12 and selectively removed radially through said slot 16 to releasably retain the portion 26 of the cover 12 within the slot 16 of the tubular member 14 as is best shown in FIG. 2C. The first means preferably at least generally comprises a necked portion, indicated generally at 30, extending through slot 16 and a transversely larger head portion, indicated generally at 32, which is supported by the necked portion 30 within the tubular member 12 across the slot 16. More preferably, the first means comprises a generally T-shaped portion also indicated at 28 projecting from the track 22. The portion 28 of the track 22 may be formed integrally with the remainder of the track 22 or it may be formed separately and attached to the track 22 by conventional mounting means, such as fasteners or adhesive. Preferably, the portion 28 of the track 22 is formed integrally with the remainder of the track.

The T-shaped portion 28 preferably includes a first planar member projecting outwardly from the track 22, which is also indicated at 30 and which constitutes the necked portion and part of the head portion, and a second planar member oriented generally laterally with respect to the first member 30. The second member is also indicated at 32 and constitutes the remainder of the head portion.

The term "width" as used herein will refer to the major cross-sectional dimension of a longitudinal member or element. The remaining cross-sectional dimension will be referred to as the "thickness". The width of the first member 30 is measured in a direction radial to tubular member 14 and slot 16 and is generally greater than the thickness of the wall of the generally tubular member 14 proximate the slot 16. The thickness of the first member 30 is less than the width 20 of the opening 18 of the slot 16.

The width of the second member 32 is measured perpendicularly to first member 30 and is also preferably greater than the width of the slot 16 for retaining the second member 32 within the slot 16. The second member 32 preferably further comprises a first arm 36 and a second arm 38, extending away from opposing sides of the first member 30. Each arm 36, 38 has a width in a direction extending away from first member 30. The width of the first arm 36 is preferably greater than the width of the second arm 38. The width of the first arm 36 and the thickness of the first member 30 are collectively greater than the width of the slot 16 while the width of the second arm 38 and thickness of first member 30 are collectively less than the width of slot 16 so that member 22 can be inserted and removed and the first arm 36 retained in the slot 16 when the assembly 10 is oriented with the first arm 36 extending upwardly, as shown in FIG. 2C while first member 30 rests on the lower edge of slot 16.

As best shown in FIG. 2C, the track 22 also includes a second means for receiving and permitting sliding movement of a plurality of retainers or hooks 40 for a depending curtain. The second means preferably comprises a generally C-shaped portion 42 of the track 22, the lower half of which defines a slot or groove 43 receiving and permitting sliding movement of a plurality of retainers 40. The C-shaped portion 42 of the track 22 is generally positioned opposite the T-shaped portion 28 of the track 22.

The C-shaped portion 42 of the track 22 is preferably formed integrally with the T-shaped portion 28, although one of ordinary skill in the art would understand that the C-shaped portion 42 may be formed separately from the remainder of the track 22 and attached thereto by conventional fastening means or adhesive, for example.

The C-shaped portion 42 has an opening 44, indicated in FIG. 2A, for receiving retaining and permitting sliding movement of a plurality of hooks 40. The hooks 40 support at least one depending curtain (not shown). One of ordinary skill in the art would understand that a plurality of curtains, such as a shower curtain and shower curtain liner, may simultaneously depend from the hooks 40. Preferably, the hooks 40 have a T-shaped portion 46 sized to be accommodated within the C-shaped portion 42 of the track 22. Preferably, hook portions 46 and C-shaped track portion 42 are sized so that the track guides the hooks linearly along track 22 without twisting or overlap of the hook portions 46 which might trap or damage the hook(s) or disrupt the smooth sliding motion of the hooks. The hooks 40 also preferably include a J-shaped portion 48 for receiving the curtain. One of ordinary skill in the art would understand that the shape of the portion 48 may vary as desired. For example, the portion 48 may be button-shaped.

The method for assembling the curtain rod assembly 10 in accordance with the present invention will now be discussed generally.

Prior to mounting the assembly 10 on the wall of a room, essentially the entire length of the tubular member 14 is inserted into the pliable cover 12. Preferably, gathers 24 are formed in the pliable cover 12 by compacting longitudinal sections of the cover 12. Once the cover 12 has been arranged as desired to cover the tubular member 14, the excess portion 26 of the cover 12 can be inserted through slot 16. For example, portion 26 can be pushed through slot 16 with a yardstick or similar thin, rigid, flat object. This facilitates insertion of track 22.

Track 22 is then positioned within the slot 16. As best shown in FIGS. 2A–C, the track 22 may be positioned within the slot 16 by pressing the first arm 36 of the track 22 against the portion 26 of the cover 12 to insert the first arm 36 and portion 26 radially into and through the opening 18 of the slot 16 (see FIG. 2A). The track 22 is then moved upwardly, as shown in FIG. 2B, and the second arm 38 is inserted radially into the slot 16, together with the remainder of portion 26 of the cover 12. The track 22 is moved in a downward direction such that first member 30 rests on a lower edge of slot 16 with the distal ends of arms 36 and 38 nesting against the inner circumferential surface of tubular member 14 adjoining slot 16, above and below slot 16. The portion 26 of the cover 12 is securely retained within the slot 16, pinched between tubular member 14 and portions of the T-shaped first means portion 28. The second member 32 of the T-shaped portion 28 of the track 22, having a width greater than the width of the slot 16, retains the gathered cover 12 in position and prevents the track 22 from slipping from the slot 16. Also, the cover 12 and its gathers may be adjusted on the tubular member with the track 22 in place, since the retaining force is only the weight of the track and the dependent curtain, if in place.

The T-shaped portion 28 of the track 22 may be removed from the slot 16 by reversing the steps set forth above. More particularly, the T-shaped portion 28 may be moved upwardly to permit the second arm 38 to be removed radially outwardly through the opening 18 from the slot 16. When the second arm 38 has been removed from the slot 16, the first arm 36 may be moved generally downwardly and radially outwardly to remove the track 22 from the slot through the slot and release the cover 12. The cover 12 may be removed and laundered or a different cover 12 may be substituted, for example. Also, the cover 12 may be more readily adjusted with the track 16 in place by raising the track 16 slightly to move first member 30 and either or both arms 36, 38 out of contact with tubular member 14 and freeing some or all of cover portion 26 for the adjustment.

While a preferred embodiment has been disclosed, those of ordinary skill will appreciate that other embodiments, instrumentalities and arrangements might be employed.

One of ordinary skill in the art would understand that the first means need not be formed as the preferred, T-shaped portion 28, but may be formed in any size or shape sufficient to be releasably accommodated within the opening 18 of the slot 16 and to retain a portion 26 of the cover 12 therein. One of ordinary skill will appreciate that the first means of track 16 may be of a rigid material having any shape that includes a necked portion passing through slot 16 and an expanded portion with a width transverse to the necked portion greater than the width of slot 16, but overall size smaller than interior of tubular member 14, as the track may also be installed in the tubular member in other ways to be described. For example, the first means may comprise a second member or head portion of elliptical or ovoid or other curved shape or of a triangular or other angled shape. The first portion may even be a resiliently deformable member of almost any shape, as long as such member will expand to a dimension greater than the width of slot 16 while necking down to a thickness less than or equal to the width of slot 16 where the first means portion of track extends through slot 16. Such portion must also be removable from the slot 16 without damage to any of the components, preferably by being removed generally radially through slot 16.

One skilled in the art would also understand that the second means need not be formed as a C-shaped portion 42, but may be formed in a variety of ways. For example, an elongated groove or slot, which might resemble the lower half of the C-shaped portion, might be provided on the top side of track 22, extending substantially the entire length of the track 22, to accommodate a plurality of S-shaped hooks (not shown). The top of each S-shaped hook may be inserted into the elongated slot to permit sliding movement of the hooks and the curtain may depend from the bottom of each hook. Alternatively, while the provision of sliding capability is preferred, a second means can be provided which does not permit sliding movement of the hooks 40 and curtain, but rather retains the hooks 40 and curtain in a stationary position.

Alternatively, the assembly 10 may be assembled by inserting the T-shaped portion 28 or other first portion at one end of the track 22 into a tubular end of the portion 26 of cover 12, which has been previously passed through slot 16, and then passing the track 22 longitudinally along the slot 16 to a desired longitudinal position. A track member inserted in this manner can have a first means of almost any shape as long as it includes a necked portion which has a thickness less than the width of slot 16 and a head portion which is supported by the necked portion and which has a width transverse to the necked portion greater than the width of the slot but still sufficiently small to fit within the interior of the tubular member. The assembly 10 may then be hung in any conventional manner. For example, an expanding screw mechanism, indicated in phantom at 100 in FIG. 2A, may be provided having an outer stationary female member configured to be received and non-rotatably held within tubular member 12 by various projections formed on the inner surface of the tubular member.

Figure 3:
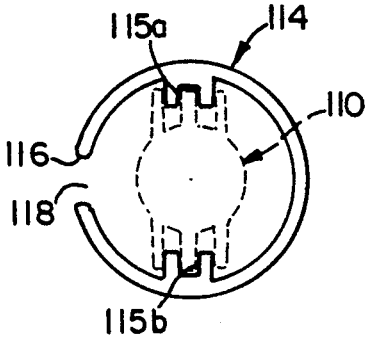
FIG. 3 is a longitudinal end view of a second embodiment tubular member.

FIG. 3 depicts the cross-sectional profile of a second tubular member 114 having a longitudinally extending slot 116, which can be substituted for tubular member 14 in assembly 10. Preferably member 114 is extruded or drawn and its cross-sectional profile is unchanging along its length. The female portion of an expanding screw mechanism or stop, which might be received in an open tubular end of member 114, is indicated in phantom at 110, non-rotatably held between two diametrically opposed, open slots 115*a*, 115*b* formed inside member 114.

It will be appreciated by those skilled in the art that still other changes could be made to the embodiments described above without departing from the broad inventive concept. It is understood, therefore, that this invention is not limited to the particular embodiment disclosed, but is intended to cover modifications which are within the spirit and scope of the invention as defined by the appended claims.

We claim:

1. A curtain rod assembly for supporting a generally tubular rod cover and a slidable depending curtain, comprising:

a generally tubular member having a longitudinal slot;

a generally tubular pliable cover surrounding substantially the entire length of said tubular member; and a track having a first means for releasably retaining a portion of said cover within said slot of said tubular member and a second means for receiving and permitting sliding movement of a plurality of retainers for said depending curtain.

2. An assembly according to claim 1, wherein said cover is fabric.

3. An assembly according to claim 1, wherein said cover has a plurality of gathers.

4. An assembly according to claim 1, wherein said first means comprises a generally T-shaped portion projecting from said track.

5. An assembly according to claim 4, wherein said T-shaped portion comprises a first member projecting outwardly from said track and a second member oriented generally perpendicularly to said first member, said second member having a width greater than a width of said slot for retaining said second member within said slot.

6. An assembly according to claim 5, wherein said second member further comprises a first arm and a second arm, each arm having a width, said width of said first arm being greater than said width of said second arm.

7. An assembly according to claim 1, wherein said second means comprises a generally C-shaped portion of said track.

8. An assembly according to claim 6, wherein said second means comprises a generally C-shaped portion of said track positioned opposite said generally T-shaped portion of said track.

9. An assembly according to claim 1, wherein the track has a longitudinal direction and unchanging cross-sectional profile perpendicular to the longitudinal direction.

10. An assembly according to claim 9, wherein the tubular member has a longitudinal direction and unchanging cross-sectional profile perpendicular to the longitudinal direction.

11. An assembly according to claim 1, wherein the tubular member has a longitudinal direction and unchanging cross-sectional profile perpendicular to the longitudinal direction.

12. A curtain rod assembly for supporting a generally tubular rod cover and a slidable depending curtain, comprising:

a generally tubular member having an elongated longitudinal slot; and a track having a first means configured for being inserted generally radially through said slot with a portion of said cover and retained by said tubular member and for being selectively removed from said tubular member by withdrawal radially through said slot so as to releasably retain said portion of said cover within said slot and a second means for receiving and permitting sliding movement of a plurality of retainers for said depending curtain.

13. An assembly according to claim 12, further comprising said plurality of retainers supported by said second means.

14. An assembly according to claim 13, wherein said first means comprises a necked portion extending through said slot of the tubular member and a head portion supported by the necked portion, the head portion having a width transverse to the necked portion greater than a width of said slot.

15. An assembly according to claim 14, wherein said necked portion is provided by a first member and said head portion is provided by a second member supported by the first member within the tubular member, the first member dividing the second member into two arms on opposite sides of the first member, each arm having a width transverse to the first member, and the widths of the two arms being different from one another.

16. An assembly according to claim 15, wherein the second means extends at least substantially entirely along the length of the tubular member.

17. An assembly according to claim 16, wherein the track has a cross-sectional profile unchanging along the length of the track.

18. A curtain rod assembly for supporting a generally tubular cover and a slidable depending curtain, comprising:

a generally tubular member having a longitudinal slot therein defining an opening in said tubular member of a given width; and a track having a first means for retaining a portion of said cover within said slot of said tubular member, said first means comprising a shaped portion projecting from said track, said shaped portion comprising a first member and a second member oriented generally transversely to said first member, said second member comprising a first arm and a second arm extending away in opposing directions from the first member, each arm having a width in a direction laterally away from the first member, a sum of the widths of said first arm and said second arm being greater than said width of said slot for retaining said second member within said slot, said width of said first arm being greater than said width of said second arm, said track having a second means for receiving and permitting sliding movement of a plurality of retainers for said depending curtain.

19. An assembly according to claim 18, further comprising a pliable, generally tubular fabric cover surrounding said tubular member substantially over the entire length thereof.

20. An assembly according to claim 18, wherein said first means comprises a generally T-shaped portion and said second means comprises a generally C-shaped portion of said track.

* * * * *